United States Patent [19]

Goodwin

[11] 3,987,722

[45] Oct. 26, 1976

[54] DUAL PRINTING WITH SINGLE MASTER SUPPLY SOURCE

[75] Inventor: Eber Lyle Goodwin, Arlington Heights, Ill.

[73] Assignee: Addressograph Multigraph Corporation, Cleveland, Ohio

[22] Filed: Dec. 30, 1974

[21] Appl. No.: 537,088

[52] U.S. Cl. ..... 101/91; 101/141; 101/231; 101/426; 101/450

[51] Int. Cl.[2] ..... B41L 45/06

[58] Field of Search ..... 101/136–145, 101/45, 91, 132, 2, 229–231; 270/12–15

[56] References Cited

UNITED STATES PATENTS

| | | | |
|---|---|---|---|
| 631,424 | 8/1899 | Firm | 270/12 |
| 2,873,113 | 2/1959 | McWhorter | 270/12 |
| 2,896,535 | 7/1959 | Schunemann | 101/152 |
| 3,224,759 | 12/1965 | Wolf | 271/64 |
| 3,264,981 | 8/1966 | Burger | 101/144 |
| 3,650,204 | 3/1972 | Burger | 101/144 |

*Primary Examiner*—Edgar S. Burr
*Assistant Examiner*—A. Heinz
*Attorney, Agent, or Firm*—Russell L. Root

[57] ABSTRACT

Duplicating equipment is provided for printing on both faces of the same sheet or, in the alternative, making two impressions on the same face (e.g., in different colors) by means of two printing heads. Both printing heads are served with masters from a single supply point, the masters being fed in proper order and attached to the master cylinder of the appropriate printing head automatically. In one form of the invention, the single master supply point takes the form of a single master maker and converter.

20 Claims, 10 Drawing Figures

MASTER FEED
S1
R6
R4
R1
R2
R3
R5
S2
S3
MASTER INSERT HEAD I
MASTER INSERT HEAD II
1ST MASTER TO 2ND HEAD
1ST MASTER TO 1ST HEAD
R5-1
R6-1
R4-2
R2-3
R1-2
R2-2
R4-1
R1-1
R2-1
R3-1
R2-4
R3-2
144
145
146
148
150
152
156
158
160
162
162a
162b
164
166
166a
166b
167
168
170
170'
172
172'
174
176
178
180
182
184
108
114
130
138
195
196

DUAL PRINTING WITH SINGLE MASTER SUPPLY SOURCE

BACKGROUND OF THE INVENTION

This invention relates to printing or duplicating and more particularly to dual printing in which a copy sheet is acted upon by each of two printing heads. Examples of this type of equipment are duplicators such as the Multilith Model 2675 manufactured by Addressograph Multigraph Corporation. This particular machine is a lithographic duplicator which serves both in offices and in print shops wherever dual printing is required. Such machines are capable of printing copy sheets with two impressions on the same face, such as two impressions in different colors, or of printing upon both faces of a single copy sheet by providing a turnover mechanism between the dual print heads. Each print head is equipped with automatic master insertion and ejection in keeping with known mechanical arrangements. Equipment of this sort is well-known and has long been in effective use.

With the increase in the use of duplicators in office systems where many runs of short duration are required, some duplicators have been developed which take masters one at a time from a stacked supply or from a master maker, and automatically attach each one in turn to the master cylinder, print the necessary copies, and eject the master, repeating this process with each new master.

Up until the time when this invention was made, no very practical means for handling the automation of master supply to dual systems had been discovered, because of the inherent complexities and expense related to mechanism for supplying the two print heads with masters, and to the problems inherent in trying to insure that each head would receive a master correctly related to the master simultaneously being supplied to the other head.

Printing operations with two impressions per sheet have, accordingly been normally confined to rather extended runs in which the time required for operator installation and removal of masters from the two master cylinders was not a significant factor in the overall operation. It is, however, becoming more and more important for many reasons, including economic and ecological, to make dual impressions, usually one on each face of the sheet (known as duplexing), and this is also true with respect to short, systems type, duplicating runs. Under the latter circumstances, the time and attention which the operator must devote to the proper selection, attachment and removal of masters becomes a very high fraction of the total run time, is extremely burdensome for the operator, and take his attention from equally important activities related to the overall duplicating process.

According to certain existing systems, automatic feeding of masters to each of the two print heads and discharge therefrom is arranged for, but this still involves very significant operator control because the masters must be so stacked and coordinated at the separate heads that each one will be properly related to its associated master in the other stack to insure printing on the same copy sheet. If errors in this regard should occur, the operator would not have any ready way of detecting this fact, and the result could be very costly in time and material. These systems, furthermore, do not permit automatic imaging of masters from a given set of original documents and automatic feeding of such masters to the print heads, both of which characteristics are provided in this invention.

SUMMARY OF THE INVENTION

According to the present invention mechanism has been developed for supplying masters automatically to the two print heads of a dual head duplicator, in which the masters for both heads emanate from a single source, the masters being fed alternately, first to one printing head and then to the other. Means are provided for effecting this alternation in an automatic manner without operator supervision, so that the only concern of the operator is that the stacking or streaming of the masters shall be in accordance with a predetermined plan which will put each pair of masters which are to run simultaneously in the stack or stream in side-by-side relation. In fact, it is possible, in accordance with this invention, to stack all of the masters in page number order, have them properly fed to the appropriate printing head automatically, and then to deliver the copy sheets, printed on both sides, to collator bins in correct page number order.

This is important not only from the standpoint of simplicity of setup and operation which insures improved accuracy but it is further important since it requires only a single mechanism of master supply, which thereby significantly mitigates the cost of the equipment. Since master supply functions are normally performed largely during the period of time occupied by a printing run, the convenience and cost reduction aspects of the single master source can be successfully enjoyed without any significant speed penalty in the overall operation.

The invention herein described contemplates not only the type of operation discussed immediately above, but also includes equipment which is capable of being quickly converted to other types of operation. For example, the machine of the present invention may be readily converted to print each copy sheet on one side with two impressions, in which the pair of masters used for the impressions are both changed for each new run. As another example, the machine may also be so converted as to print permanent information at one of the print heads, with new masters being fed automatically in sequence only to the other print head at the beginning of each run, and this can be so arranged that the information which is automatically changed with each run is imprinted either on the same side of the copy sheet as the permanent information, or on the opposite side therefrom. Thirdly, it is possible readily to convert the equipment of the invention to a condition of operation such that one head only is used for printing on one face of each copy sheet in the customary manner.

In addition, the invention herein contemplates methods of operating the machine to achieve a variety of different desired results in a very direct and ready fashion without introducing undue expense into the equipment in terms of complex automatic controls.

For example, in connection with the problem of correct orientation of masters, it is particularly pointed out that the customary inversion systems used for copy sheets would normally require that the masters should print on one face with the top edge of the page leading, and on the other with the bottom edge of the page leading, and this would normally require that each alternate master be inverted in the stack in order to have the copy sheets end up with the information on both faces headed in the same direction. However, this can also introduce further problems, because the copy sheets will now be registered for printing first from the top edge and then from the bottom edge which introduces complications in attempting to have all of the print material on adjacent pages appear at the same page level; i.e., the same width of top margin— a condition which is much to be desired in order to achieve a finished appearance of an assembled booklet. According to the present invention, these problems are largely avoided by the novel process of feeding the masters and the copy sheets normal to their vertical edges (usually the longer edges) of the sheets, so that the page side edges now become the leading and trailing edges during printing. When this is done, both masters and sheets will all be headed in a single direction during printing runs, so that variations in the top margin of the page can be readily controlled by merely imaging all masters at the same distance from the top edge, and the masters may all be placed in one direction at the supply source, (or the originals may all be streamed into the master maker with the same orientation), requiring no operator shuffling of the source sheets prior to printing.

Another process which forms a part of the present invention involves the largely automated printing of four-page signatures in two passes. A first pair of masters, when inserted on the print head, will print on a double length copy sheet (say 11 by 17 inches), pages 1 and 3, for example, on opposite faces thereof. When this run is completed, then the copy sheet stack is turned end-for-end (or inverted) and printed again. This time another pair of automatically inserted masters will produce pages 2 and 4 (or 4 and 2) on the opposite faces of the copy sheet, thus providing a four page signature which may be folded and used as a booklet. Some prearranging of the master supply to meet the needs of the process is required in this situation, with the page tops being alternately oriented to left and to right for the succeeding runs.

While the description will proceed to discuss the invention principally in terms of an offset lithographic duplicator, it will be understood that the principles can be broadly applied equally to other types of duplicators as well.

DESCRIPTION OF THE PREFERRED EMBODIMENTS

Figure 1:
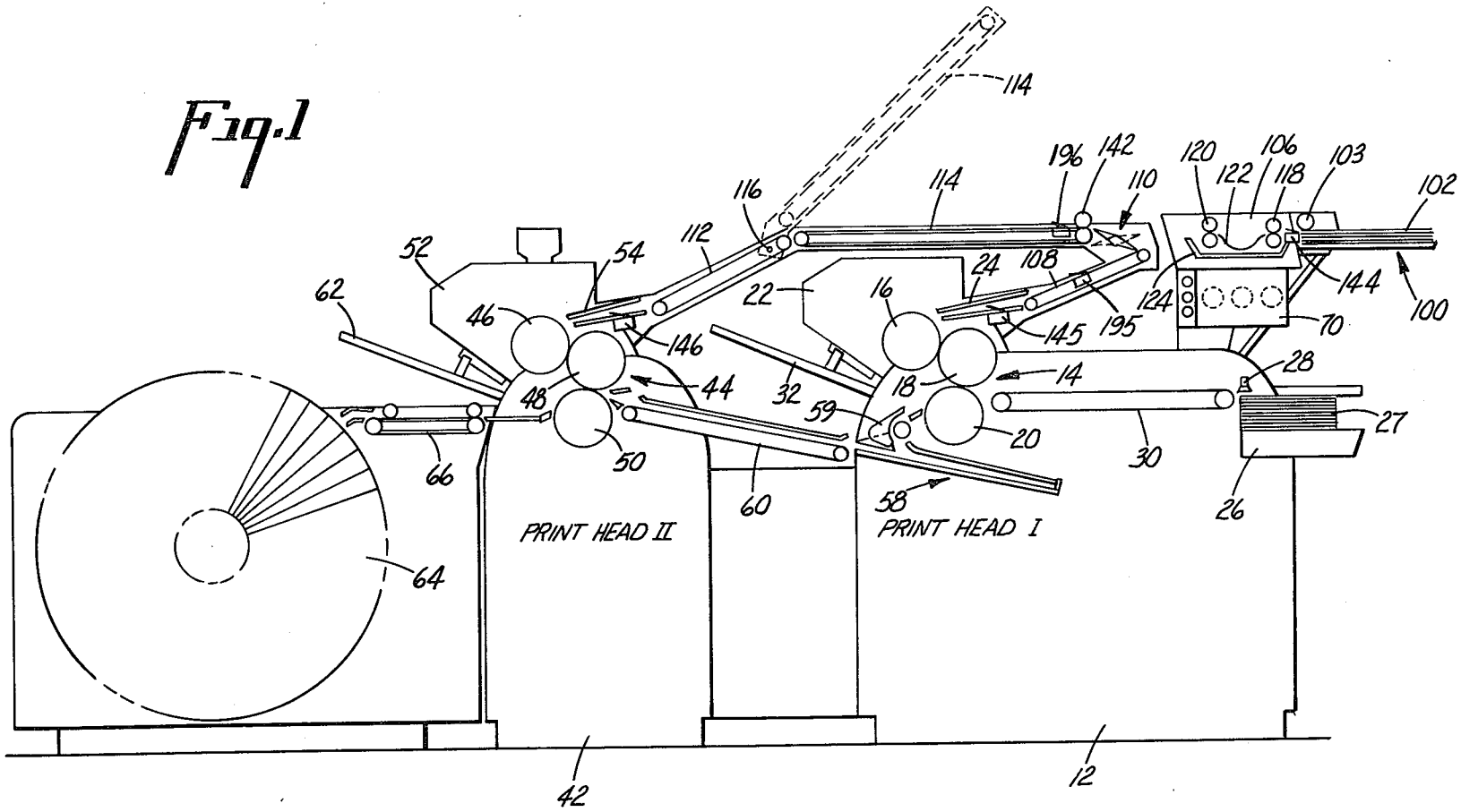
FIG. 1 is a diagrammatic elevation of a duplicator according to the present invention.

FIG. 1 shows a lithographic duplicator 10 comprising a main duplicator section 12 having a first print head 14 including a master cylinder 16, a blanket cylinder 18, an impression cylinder 20, an ink and moisture system 22 and a conventional master insertion mechanism 24. A copy paper supply hopper 26 holds a stack 27 of copy paper for feeding sheets seriatim to the nip of the cylinders 18, 20 by means of a suction foot separator 28 and a sheet conveyor 30. A receiver for spent masters is indicated at 32, and masters detached from the master cylinder 16 by conventional master ejection mechanism are deposited therein.

An auxiliary duplicator section 42, placed in tandem with the section 12 has a good print head 44 which includes a master cylinder 46, a blanket cylinder 48, an impression cylinder 50, an ink and moisture system 52, and a master insertion mechanism 54.

Copy sheets which have been printed upon by the first head 14 are routed to the second head 44 via a conveyor 60, either directly or after having been inverted by a turnover mechanism including a chute 58 and a deflector 59. Each sheet passes through the printing nip 48, 50 and then is deposited in a pocket of the collator 64 by a conveyor 66. Numeral 62 represents a receiver for spent masters ejected from the master cylinder 46 by conventional master ejection mechanism.

A counter 70 is provided for controlling the number of copies printed by the machine in a well-known manner.

As thus far discussed, the equipment described represents lithographic duplicating apparatus of a well-known type for providing copy having two printing impressions, either both on one surface, or placed on opposite surfaces of the sheet.

According to the present invention there is provided a master supply source, shown in FIG. 1 as a pack feeder 100, in which the operator can place a stack 102 of masters suited for the printing of copies by a lithographic process. The feeder 100 is arranged normally to take masters one at a time from the stack 102 and feed them forward, as by a feed roller 103, to a master conversion device 106 mounted on the frame of the main duplicator section 12. Also mounted on the frame of the duplicator section 12 are a conveyor 108 connecting the master conversion device with the master insertion mechanism 24, and a deflector mechanism 110.

A conveyor 112 is mounted on the auxiliary duplicator section 42 leading to the master insertion mechanism 54, and connected to the free end thereof is a conveyor 114 which joins conveyor 112 with the deflector mechanism 110. The conveyor 114 forms a bridge over the first print head 14 and is preferably hingedly mounted as at 116 and releasably connected at its other end by any suitable quick release latch means to allow raising the same to the dotted line position in FIG. 1 for ready access to the print head 14 when necessary. This conveyor section is also mounted for ready removability when required.

The master conversion device 106 is of a previously known configuration, is individually powered, and includes a pair of infeed rollers 118, a pair of outfeed rollers 120, and a guide means 122 for leading a master sheet through a batch of solution in a tray 124. Various conversion or premoistening solutions may be used in the tray, depending upon the type of masters to be employed, but the preferred form is a solution sold under the trademark MULTILITH by Addressograph Multigraph Corporation and identified by No. 200-1056, which solution has general purpose characteristics, and is suitable for converting electrostatically imaged zinc oxide sheets for lithographic use as well as for etching or premoistening lithographic masters of the direct image type.

The conveyor is mechanically connected to and driven by the power equipment associated with the main duplicator section 12, and the conveyors 112 and 114 are mechanically connected to and driven by the power system of the auxiliary duplicator section 42 in a conventional manner.

Figure 2:
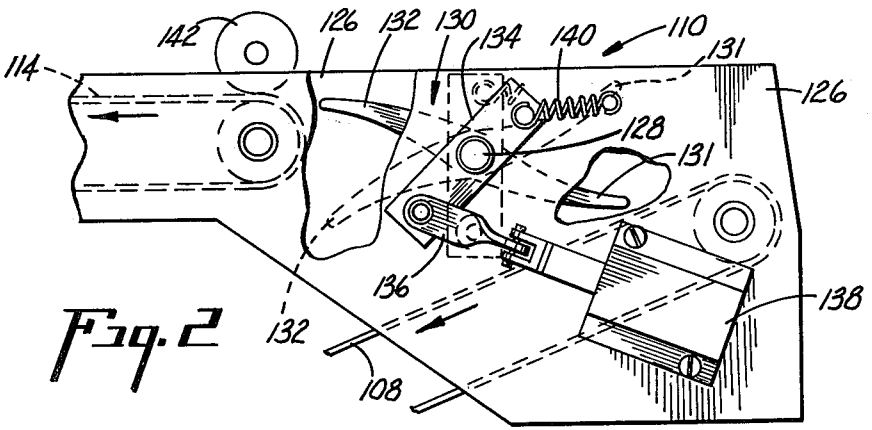
FIG. 2 is a detail elevation to larger scale showing the deflector mechanism for controlling routing of masters.

In FIG. 2 the deflector mechanism is shown in detail, and includes side plates 126 between which is mounted a shaft 128 capable of rocking motion about its axis. Affixed to the shaft is a gate 130 including two series of oppositely directed fingers 131 and 132 which act on a master as it issues from the master conversion device 106 to direct the master either to the conveyor 108 or to the conveyor 114. At one end of the shaft exteriorly of the side plate is affixed a crank arm 134. One end of the crank arm is connected by a link 136 to the plunger of a solenoid 138, and the other to a tension spring 140.

As can be seen in FIG. 2, the spring 140 normally urges the shaft 128 in a clockwise direction, and tends to hold the fingers 131 and 132 in their solid line positions such that a master issuing from the conversion device 106 will be guided towards the conveyor 114 so as to have its leading edge caught in the nip between the belts of the conveyor and a pressure roller 142, and thus to be transported to the second print head 44. On the other hand, when the solenoid 138 is energized, it rocks the shaft 128 to a counterclockwise position in opposition to the force of spring 140, and thereby moves the fingers 130 and 132 to their dotted line positions. The finger 130 is then in a position too high to intercept the leading edge of a master issuing from the conversion device 106, so that it will be carried by gravity onto the surface of the conveyor 108 and directed to the first print head 14.

A control circuit is provided for directing the masters, each in turn, to the appropriate print head, and this includes the sensing switches shown in FIG. 1. Specifically a master entry sensing switch 144 is located between the feed roller 103 of the pack feeder and the infeed rollers 118 of the conversion device, a sensing switch 145 is located at a rest position just ahead of the master cylinder 16 of the first print head, for detecting the presence or absence of a master awaiting insertion, a similar sensing switch 146 is located just ahead of the master cylinder 46 of the second print head, and "in transit" sensing switches 195 and 196 are located along the conveyors 108 and 114 respectively.

Figure 3:
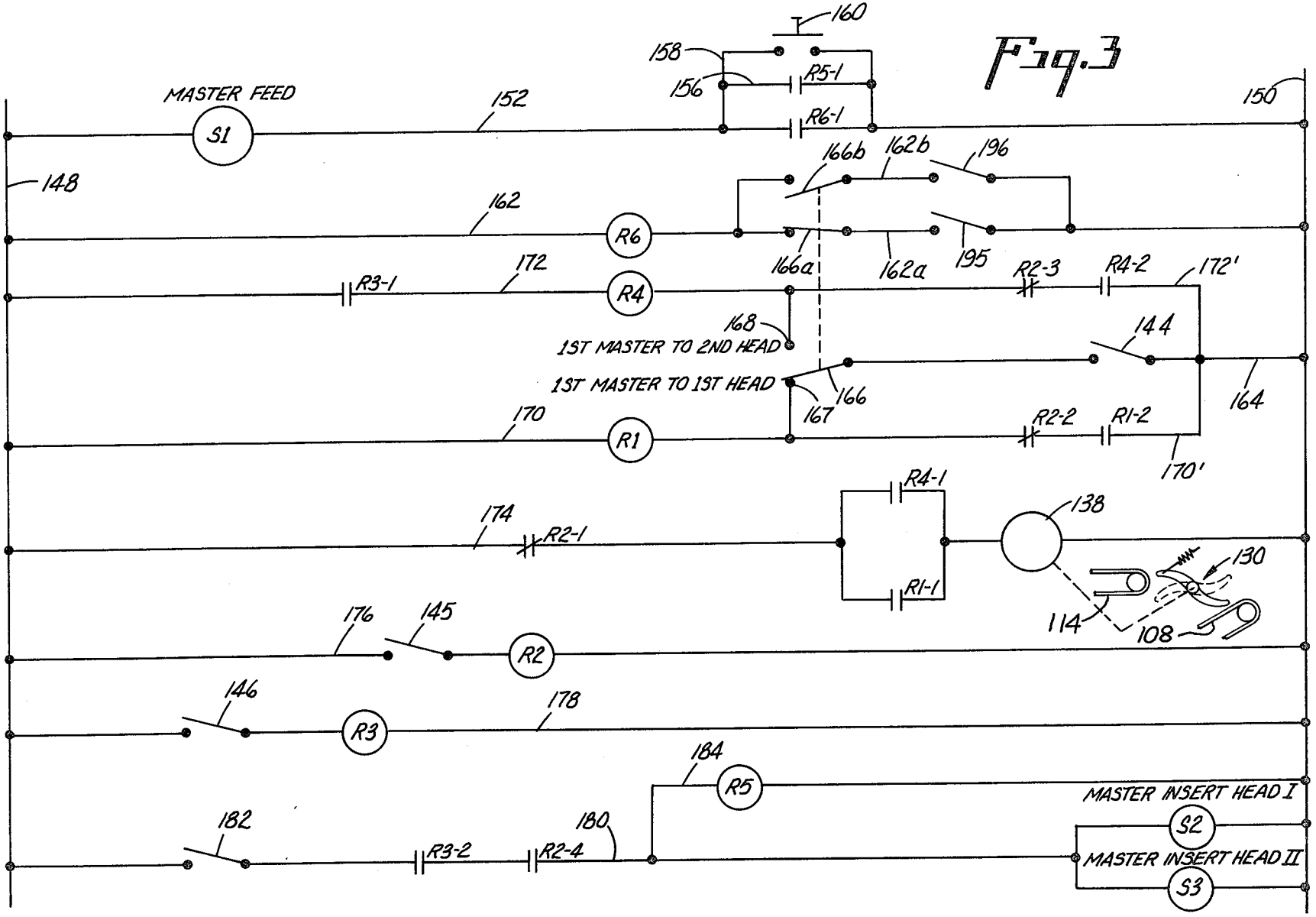
FIG. 3 is a schematic electrical diagram of the mechanism for controlling the supply of masters for the duplicator.

An exemplary circuit by which the feeding of masters may be controlled is shown in FIG. 3, wherein the switches 144, 145, 146, 195 and 196 are indicated by the same reference characters as in FIG. 1. The circuit embodies the power leads 148 and 150 between which the subcircuits are connected.

Reading from the top down, a conductor 152 between the power leads is loaded by a solenoid S1 which controls the feed of masters via roller 103 (FIG. 1), for example, by tripping a conventional single revolution clutch. Control of current flow is by way of a pair of contacts R6-1 of a relay R6 which will presently be described. A bypass control alternatively controlling energization of solenoid SI by way of conductor 156 involves normally open relay contacts R5-1 to be later discussed, and another parallel conductor 158 which includes a manual momentary push button switch 160.

Conductor 162 serves the relay R6, just mentioned above, and current flow therethrough is regulated by switches in a pair of parallel conductors **162*a* and 162*b*. In conductor 162*a* is the sensing switch 195, and in conductor 162*b* is the sensing switch 196, both previously described in connection with FIG. 1. Manually operable selector switches are also associated with these conductors; namely, switch 166*a* in conductor 162*a* and switch 166*b* in conductor 162*b*. The switches 166*a* and 166*b* are tied together mechanically for alternate operation, and also move jointly with selector switch 166** to be later described.

One terminal of master entry switch 144 is connected by a conductor 164 with the power lead 150, and its other terminal is connected with a manually operable selector switch 166, the blade of which can make contact either with a contact 167 or a contact 168. Contact 167 is associated with a branch circuit including conductor 170 which includes a relay coil R1, and is related to putting the first master of a pair onto print head I and the second onto print head II. Contact 168 is associated with another branch circuit 172 which includes in series a relay coil R4 and a pair of normally open relay contacts R3-1 of a relay R3 to be subsequently described, and is related to putting the first master of a pair onto print head II and the second onto print head I. As noted above, switch 166 is mechanically associated with and operates in concert with switches **166*a* and 166*b*. Holding circuits for the relays R1 and R4 are respectively provided by conductors 170′ and 172′. The former includes in series normally open holding contacts R1-2 of relay R1, and normally closed release contacts R2-2 of a relay R2 to be presently described. Similarly, the conductor 172′ includes normally open holding contacts R4-2 of relay R4 and normally closed release contacts R2-3 of the relay R2** to be presently described.

A conductor 174, between power leads 148 and 150, includes normally open contacts R1-1 and R4-1 of the relays R1 and R4 respectively, said contacts being connected in parallel, and in series therewith a pair of normally closed contacts R2-1 of the relay R2 to be presently described, said contacts controlling the energization of the gate solenoid 138 of FIG. 2 which is also in series in the conductor 174.

A conductor 176 powers the relay R2 under control of a series switch, which is the sensing switch 145, closed by a master when it arrives adjacent the first print head.

A conductor 178 powers the relay R3 under the control of the sensing switch 146, closed by a master when it arrives adjacent the second print head.

A conductor 180 serves solenoids S2 and S3, connected in parallel, which operate in a known manner to mechanically trigger the insertion of masters onto the master cylinders of the first and second print heads respectively. The energization of the solenoids is under the control of several switches all in series in the conductor 180. The first is switch 182 which is activated to closed position momentarily whenever the second printing head signals mechanically (in a well-known manner forming no part of the present invention) that ejection of a master from the master cylinder of the second head has been completed. The other two series switches are normally open contacts R3-2 and R2-4 of relays R3 and R2 respectively. In addition, the switch 182 and contact sets R3-2 and R2-4 also control energization of a relay R5 which occupies a circuit in shunt with the master insertion solenoids and characterized as conductor 184.

In operation, the machine is turned on and the print heads 14 and 44 idle in the customary manner. The operator, having previously arranged the masters in the proper sequence in a stack 102, places the stack in the hopper of the pack feeder 100. For purposes of the description immediately following it will be considered that the machine is being used in the duplexing mode for printing on both sides of each copy sheet, and that an orientation plan is adopted in accordance with that in FIGS. 5 and 6, wherein the masters are shown stacked in page number order with the master bearing the page 1 image on the top of the stack, followed by the page 2 master, the page 3 master, etc. In this situation the operator sets selector switch blade 166 on contact 167 (the full line position in FIG. 3) to direct the first master of each pair to the print head I (designated 14). This action simultaneously closes switch **166*a* and opens switch 166*b*.**

The operator presses button 160 momentarily, thereby energizing the solenoid S1 which engages a one-revolution clutch and starts the first master (i.e., the master for printing page 1) moving out of the pack feeder. As the lead edge of the master strikes the sensing switch 144, it closes the circuit and energizes relay R1. This closes contacts R1-1 energizing solenoid 138 and thereby shifting the gate 130 to the dotted line position (FIG. 2) which results in directing the first master via conveyor 108 to the rest position just in advance of the master cylinder of print head I.

As soon as the first master reaches the sensing swich 145 adjacent the master cylinder of print head I, it causes the same to close and thereby energize relay R2. This results in opening the normally closed contacts R2-1, which action breaks the circuit to gate solenoid 138 and allows the spring 140 to return the gate to solid line position, ready to receive the second master (the master for page 2) and guide it to print head II (designated 44) via conveyor 114. It also opens normally closed contacts R2-2 in the holding circuit, de-energizing relay R1, and holds this condition as long as the first master is at the rest station at print head I. Likewise, the contact sets R2-3 and R2-4 transfer, but they have no effect at this time.

In the meantime, while the first master was en route to the rest station, after leaving the conversion device 106 but before arriving at the sensing switch 145, the lead edge of that master encounters and momentarily closes the sensing switch 195. This closes a circuit energizing R6 (the switch **166*a* having been manually closed as previously mentioned). Energization of relay R6 closes contacts R6-1 thus pulsing the master feed solenoid S1 to start the feed of the second master of a pair of masters, in this case the master for printing page 2. As this second master of the pair feeds forward, it strikes sensing switch 144 to energize relay R1, but this is without effect at this time since the contacts R2-1 are being held open by the presence of the first master at switch 145. Thus solenoid 138 remains unenergized, the gate 130 remains in solid line position, guiding the second master to print head II via the conveyors 114 and 112.**

When the second master reaches rest position adjacent the master cylinder at print head II, it actuates sensing switch 146, thereby energizing relay R3 and closing contacts R3-1 and R3-2. The R3-1 contacts are at the moment without effect since they are in circuit which is presently inactive. En route to this position, the second master encountered sensing switch 196, which, if effective, would pulse the master feed solenoid S1 to start a third master. However, the setting of switches **166, 166*a*, 166*b* is such that no current flows to energize relay R6 when switch 196** closes so that no further masters are fed at this time in addition to the initial pair.

Now, with both of the first two masters in rest position, whereby contacts R3-2 and R2-4 are closed, the subcircuit identified by conductor 180 may be considered enabled, and its activity is now under control of switch 182. This is a switch which, in known manner, closes in response to the termination of the mechanical master ejection action on the second head. In the middle of an automatic run, of course, the masters at the rest stations will merely wait until the counter counts out and the preceding run is completed, at which time switch 182 closes and energizes the already enabled circuit 180. In the present case, where the machine is being started up, the switch 182 will already be found in closed position, since master ejection has already occurred at the end of the previous period of use. In any case, one or the other of the switches R3-2 or 182 finally completes the circuit and solenoids S2 and S3 are energized. These are the solenoids which initiate the mechanical master insertion action on the print heads I and II respectively in a well-known manner, and when they are energized, the two masters are automatically fed forward from their rest station and each is clamped onto its respective master cylinder, inked up, and paper feed and printing are automatically initiated in due course.

At the same time, the energizing of circuit 180 also energized the relay R5 in the circuit 184 in parallel with the solenoids S2 and S3, whereby the contacts R5-1 are closed to pulse the master feed solenoid S1 and start the cycle over again, to introduce a second pair of masters to the print heads I and II in sequence, while removal of the first pair of masters from the rest position by the act of master insertion is allowing sensing switches 145 to 146 to open, thereby de-energizing relays R2 and R3 and restoring the circuits to initial condition, ready to direct the next pair of masters to the proper locations (i.e., the page 3 master to the print head I and the page 4 master to the print head II).

Figure 5:
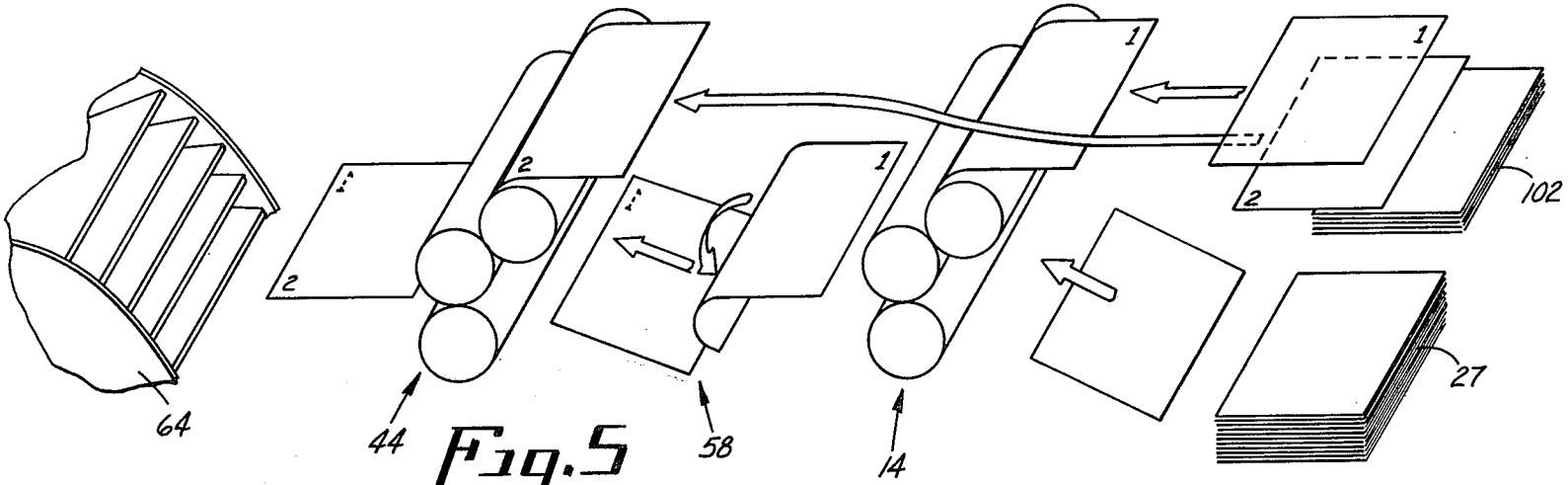
FIG. 5 is a diagrammatic perspective of the system showing the orientation of masters and its effect upon the orientation of copy sheet images.

Referring to FIG. 5, the results of the above sequence are illustrated in detail. When the page 1 master is placed on head I and the page 2 master on head II, it will be seen that the copy sheet first receives its page 1 impression on the obverse surface at print head I, is inverted, end-over-end, by the turnover device 58, receives its page 2 impression on the reverse surface at print head II, and then is fed face-down into the pocket of a collator 64 (i.e., with the page 1 impression downwardly directed).

Figure 6:
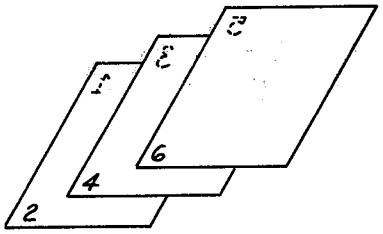
FIG. 6 is a diagrammatic perspective of the resulting stack of copy sheets according to the procedure of FIG. 5, showing the relationship of copy sheet images on a collated stack of finished sheets.

As can be seen from FIG. 6, continued operation in this manner will cause the copy sheets to stack up in each collator pocket with the pages in proper order, counting from the bottom of the stack to the top, so that the operation can proceed from a pack of masters regularly stacked in page number order directly to a completed set of duplex printed sheets with their pages in proper order, and no calculations or special prearrangement of masters in the master stack by the operator are required.

In connection with the foregoing, it is noted that, if the masters should be so oriented that the horizontal dimension of the page is parallel to the cylinder axes, then provision must be made for somehow alternating the masters, either by prestacking them in the pack feeder in alternating positions with the page top first in lead edge position and then in trail edge position, etc., or by stacking them normally as initially described, and then providing additional mechanism for alternately switching the masters to have adjacent masters feed into the duplicator with opposite headings.

According to the present invention, however, this complication is avoided by so arranging the master stack so as to have all masters oriented on the same heading, and to feed the masters (and the copy sheets, of course) into the machine in such manner that the horizontal dimension of the page is normal to the cylinder axes. When this is done, the problem of image reversal due to copy sheet inversion does not arise and the operator's task is rendered exceedingly simple. This specific arrangement also appears in detail in FIG. 5.

While the preferred method of operating the equipment for duplex printing has been described above, it will be appreciated that other sheet stacking methods are possible. If, for example, the masters in the pack feeder were arranged serially with the low number pages at the bottom of the pile and the high numbers at the top, then it would be possible to introduce the copy sheets into the collator pockets in such manner that the last page would appear at the bottom of the pile and the first page on the top, using the mode setting previously described.

In the interest of more complete flexibility, the machine of the invention is also arranged to operate in an alternate mode if the operator desires. That is, while the previous mode of operation placed the first fed master of each pair on print head I and the second fed master on print head II, the other mode operates reversely and places the first fed master of each pair on print head II and the second fed master on print head I.

Turning again to FIGS. 1 and 3, to operate in the second mode, the operator places the blade of switch 166 on contact 168, (the dotted line position in FIG. 3), thus moving switch **166*a* to open position and switch 166*b* to closed position. The operation of the machine is again started by momentarily pressing push button switch 160. As before, this starts the feed of a first master which arrives at sensing switch 144, closing the same. This, however, produces no result, since the circuit for energizing R4 is incomplete due to normally open contacts R3-1. Since R4 does not energize and contacts R1-1 are of course open at this time, there is no conductive energization path for the solenoid 138, and the gate 130 remains in solid line position, directing the first fed master to print head II via conveyors 114, 112.**

As the first master reaches the sensing switch 146 at print head II, it closes the same, thereby energizing relay R3 which causes contacts R3-1 to close, thus enabling the circuit for relay R4.

In the meantime, while the first master was en route to the rest station identified by switch 146, it encountered and momentarily closed sensing switch 196. This energized relay R6, since switch **166*b* has been manually closed along with selector switch 166. Energization of relay R6 closes contacts R6-1 thus pulsing the master feed solenoid S1 to start the feed of the second master of the pair. As this second master of the pair feeds forward, it strikes sensing switch 144 to energize the relay R4 (since contacts R3-1 are now closed as explained above). Energization of the relay R4 closes contacts R4-2 to hold the relay energized for the time being, and contacts R4-1 which provide an energization path for the gate solenoid 138, thereby moving the gate 130 to broken line position and allowing the second master to follow the conveyor 108 to the rest position for print head I. Upon arrival this second master actuates sensing switch 145, thereby energizing relay R2, which, through its contacts R2-3, breaks the holding circuit for relay R4, and through its contacts R2-1, breaks the energization path for the solenoid 138, allowing the gate 130 to restore to solid line position. In transit, actuation of switch 195 by the second master is, of course, without effect since switch 166*a*** has been opened.

In all other respects the circuit operates in a manner equivalent to that described for the first mode.

In the simplest form of the invention, if the final work product is to consist of a series of sheets printed on both sides, and requires leaving a blank face on one of the sheets at some point in the series, the most efficient and effective way to provide for this is to insert a blank master in the stack of masters at a location corresponding to the position of the blank page, which will insure that other pages remain in the proper sequence in the final product, and that the blank face appears where it should.

While the foregoing description has proceeded primarily on the basis of the use of equipment to print on both faces of the copy sheet, it will be understood that any type of dual printing can be performed with the machine of the invention. For example, by shifting the deflector 59 to inoperative position in a known manner, the copy sheets can be sent straight through without being turned over, thereby receiving two distinctive types of printing on one face of the sheet, more especially printing impressions of two different colors.

Figure 7:
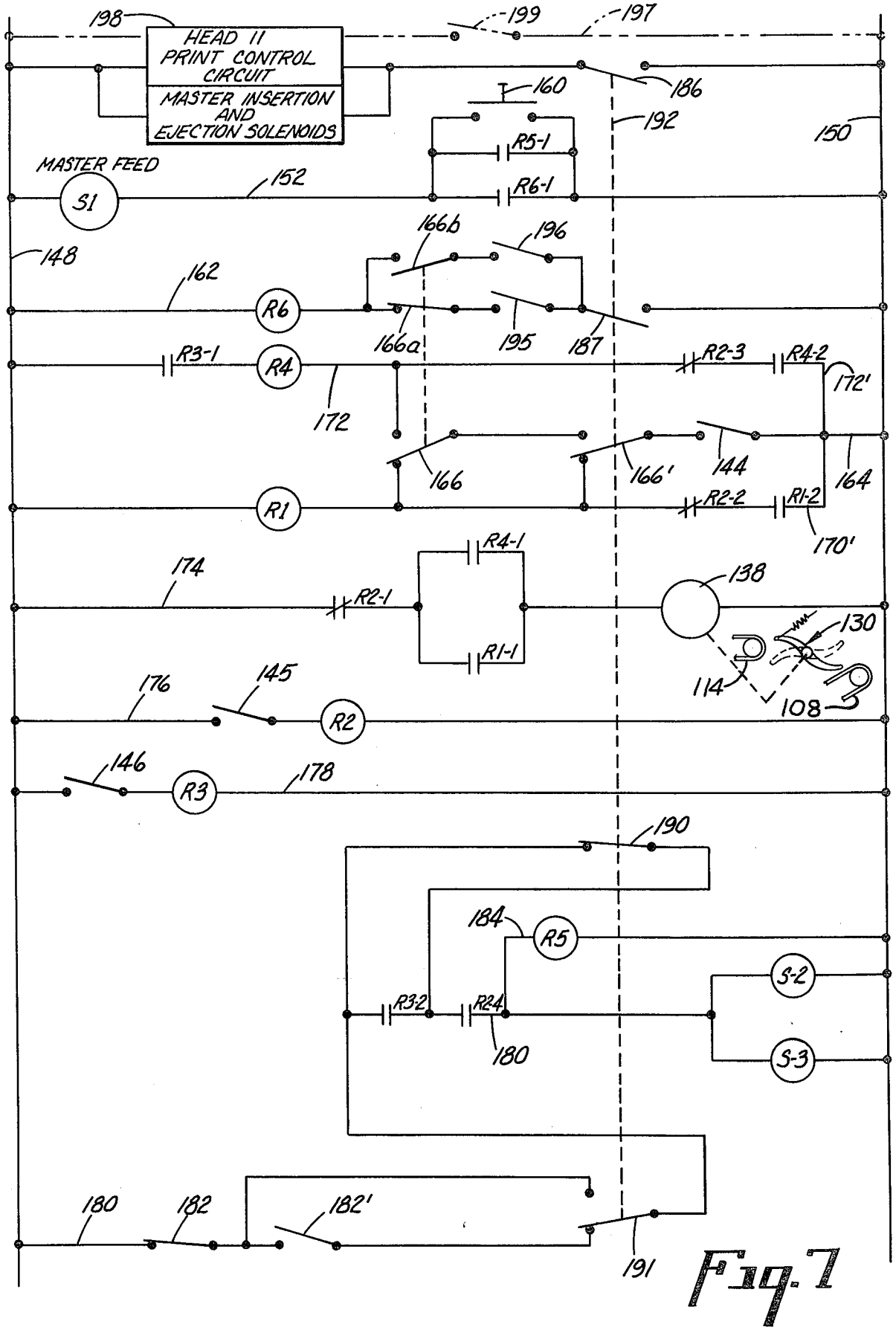
FIG. 7 is a schematic electrical diagram illustrating, in relation to FIG. 3, control means for converting the duplicator from duplex operation to single face printing, or to printing on both faces with one face receiving its impression from an unchanging master.

Furthermore, referring to FIG. 7, if it is desired to use the equipment to print on a single side only of each copy sheet with a single impression, the conventional circuits controlling the printing cycle of print head II (including the energization of master insertion and ejection circuits) which circuits are generally indicated by reference character 198 may be switched to inoperative condition by a switch 186 so that the head merely idles without printing. In addition, a switch 187 may be used to open the circuit to relay R6 so that contacts R6-1 are not pulsed, and the masters are consequently introduced individually rather than in pairs. A switch 166′, acting as an alternate to the manual selector switch 166 may be placed in first head position whereby gate 130 will be shifted to dotted line position each time a master goes through to guide each master to print head I, and contacts R3-2 may be bypassed by a shunt switch 190. Also, a master ejection completion switch 182', associated with print head I, may be switched into the circuit by means of a switch 191 to act in place of switch 182 which will stay closed under these circumstances. These switches are all preferably arranged to be operated by a single manual control 192 as illustrated in FIG. 7 wherein the switches are all shown as set in positions corresponding to the single impression mode. The balance of the circuit is essentially the same as in FIG. 3 and operates as described above in connection with that figure. Under these circumstances the duplicator can be used as a conventional machine for printing on one side only of each copy sheet, while still having the capability of conversion to any of the dual printing capabilities above-described at a moment's notice when needed.

Another mode of operation which is readily possible with the machine according to the present invention is one in which a permanent master is placed on one of the pring heads, for example an aluminum master carrying the image of a standard form, and the other print head receives a series of different masters all of which conform to and are printed with the standard form. Both impressions can be on the same surface of the copy sheet, or the permanent master image could be placed on one surface (as in the case of a fixed cover design) while the variable information is printed on the reverse surface.

Assuming, for the sake of illustration, that the permanent master is to print on print head II and the changing master on print head I, then all that is required to adjust the machine for this type of operation is to operate the manual control 192 to single head position as seen in FIG. 7. An auxiliary control circuit 197 is also provided, which includes an auxiliary control switch 199, both illustrated in dotted lines in FIG. 7. When this switch is closed it has the effect of restoring power to the print control circuits for print head II, except that the solenoids which activate master insertion and master injection remain disabled due to open switch 186. It will be understood, of course, that under these conditions the switch 182 also remains in closed position permanently as if a master had just been ejected, as previously described.

When control 192 and switch 199 are thrown as described above, the machine will operate continuously, printing the desired number of copies with the information from the changeable masters on print head I, and the fixed information from the permanent master on print head II, ejecting the changeable master on print head I, loading a new master on print head I only, with new information for the next run, printing a second run with the new master information from print head I, plus the information from the permanent master on print head II, and so forth.

In addition to the previously described arrangement wherein the duplicator is supplied with masters from a stack 102 in the pack feeder 100, it is also contemplated that the source of masters may take the form of a device for imaging masters on line with the duplicator.

Figure 4:
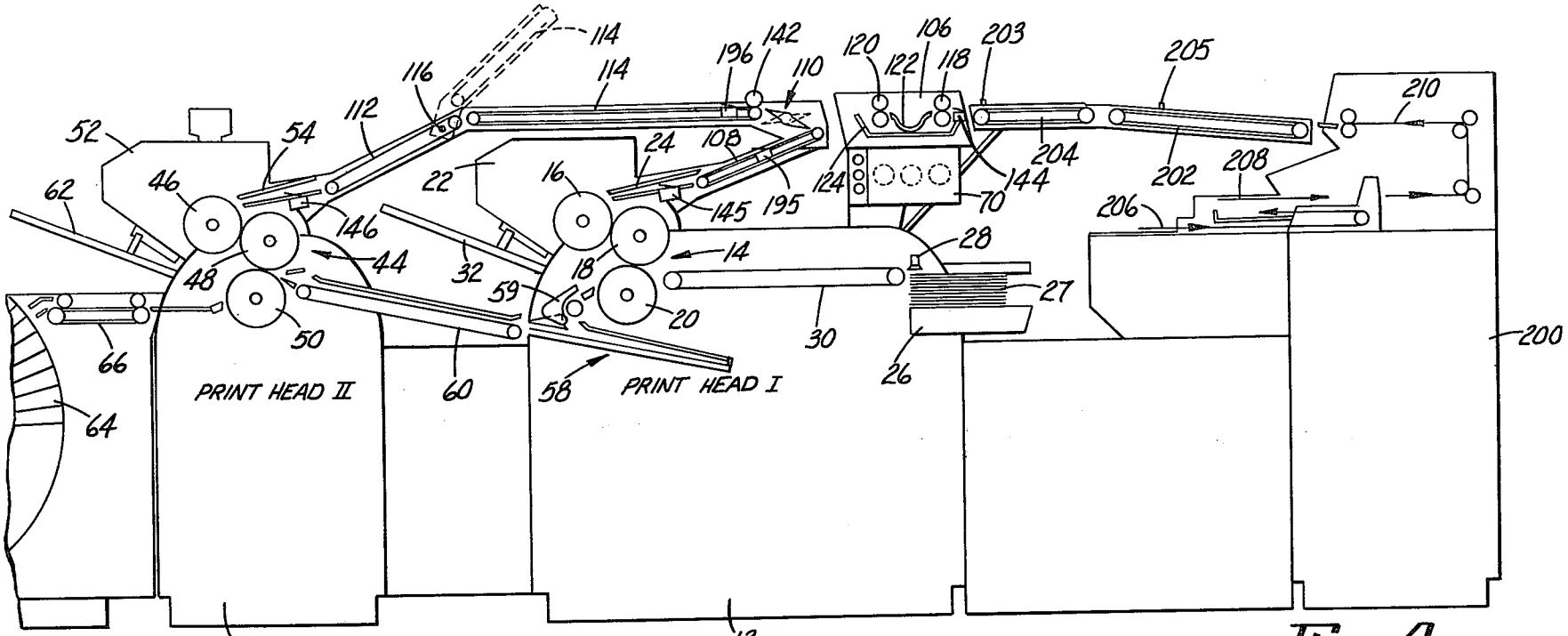
FIG. 4 is a diagrammatic elevation of a duplicator similar to FIG. 1, but in which the master supply takes the form of master-making equipment.

As shown in FIG. 4, an electrostatic master maker 200, for example, an Addressorgraph Multigraph electrostatic copier Series 2000 or 2300, may be so connected to the duplicator 10 that its output is led directly to the input of the master conversion device 106 by way of conveyors 202 and 204.

The operator inserts original at 206, and electrostatic master sheets emanating from a stack at 208, receive a copy of the original material in a known manner and are then fed out onto the conveyor 202 as indicated by arrow 210.

The conveyors 202 and 204 are so costructed, in a manner presently well-known, that there are provided rest points for several imaged masters, for example two, along the length of the conveyor. Electrical sensing circuits identify the positions of these masters and monitor their progress as the foremost master on conveyor 204 is fed forward whenever called for, and as new masters are created and enter the stream. As is customary, electrical controls are provided which call for or admit a new original only when the system has room to receive an additional master.

The locations of the masters along the conveyors are determined by stop fingers 203 and 205 which, in raised position, merely stop the progress of masters and cause them to slip on the conveyor belts, and which retract to permit continued motion. The stop finger 203 corresponds to the feed roller 103 of FIG. 1, and its retraction motion is effected by the completion of circuit 152, FIG. 3, just as is the initiation of the feeding operation of feed roller 103 in the initially described form of the invention.

The originals may be manually fed to the master maker 200 by the operator, or a pack feeder similar to the feeder 100 may be provided for automatically feeding originals to the master maker on demand in the same manner that masters are fed on demand from pack feeder 100 to the master converter in the FIG. 1 arrangement. In either case the same principles of image orientation and stacking order apply to the originals as was described for the masters in the form of the invention described in connection with FIG. 1.

Duplicators of the character shown and described herein, are commonly provided with cylinders perhaps 10 inches long by 6 inches in diameter, whose total circumference is accordingly nearly 19 inches. These machines are also often provided with "long image" (i.e., "short gap") cylinders which give a total image area of 10 inches (lengthwise of cylinder) by 16½ inches (circumferentially of the cylinder).

It is apparent that a master image whose vertical direction is parallel to the cylinder gripper could print a letter size image on the lead half (8½ × 11 inches) of an 11 × 17 inch sheet. Under these circumstances it is apparent that the balance of the cylinder circumference would remain blank, depositing no image on the trailing half of the 11 × 17 inch sheet.

Figure 8:
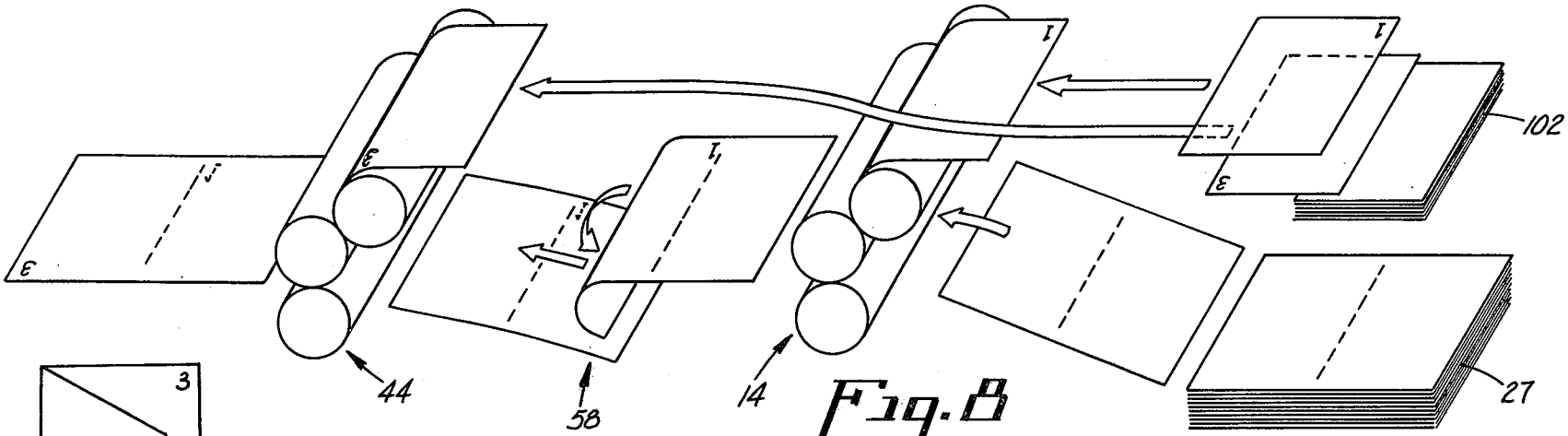
FIGS. 8 and 9 are diagrammatic perspectives, somewhat similar to FIG. 5, illustrating the process of printing a four page signature.
Figure 9:
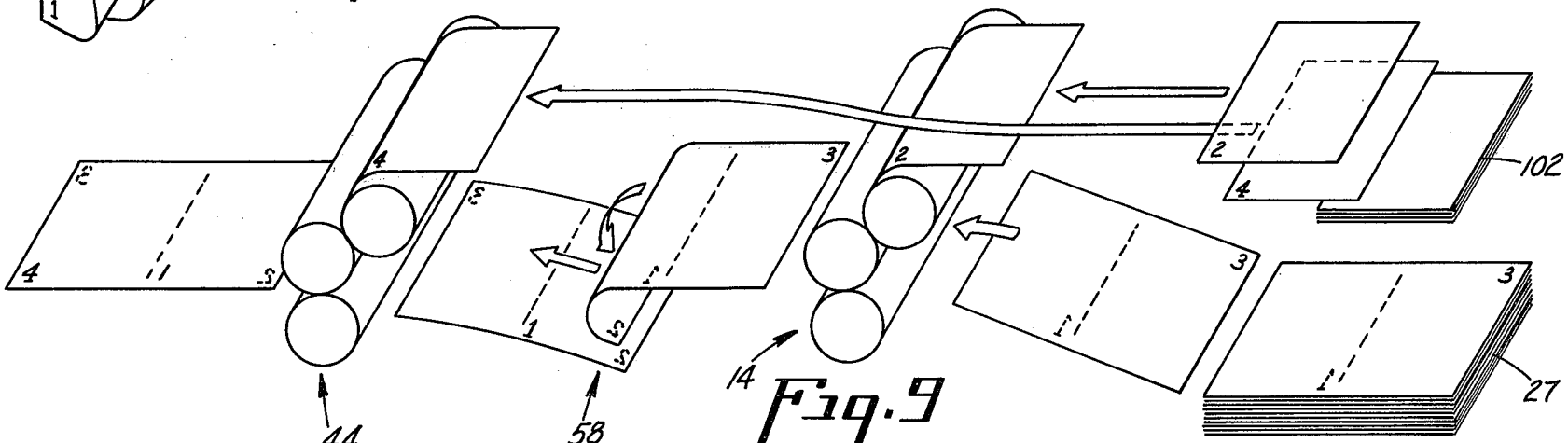
Figure 10:
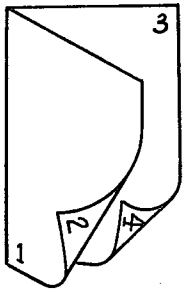
FIG. 10 is a perspective view of a completed signature.

As illustrated in FIGS. 8, 9 and 10, it is also possible to use the equipment of the present invention to produce signatures with minimum operator intervention, and the method for doing so also forms part of this invention.

FIG. 8 shows an arrangement in which double size copy sheets (for example 11 by 17 inches) are fed to the first print head 14 from a stack 27, with an 11 inch end forming the leading edge. At the print head 14 the upper surface is printed on its leading half by a master representing page 1, and the sheet is then turned over and sent to print head II, indicated at 44, where the lower surface, now in upper position is printed on its leading half by a master carrying the image for page 3.

When the above described printing run has been completed, the stack of partially printed copy sheets is turned end-for-end and replaced at the copy supply station. As seen in FIG. 9, the next masters in the stack represent pages 2 and 4, and these are turned with their heads in the opposite direction from pages 1 and 2. As this printing run starts, page 2 is printed on the lead half of each sheet, the sheet is inverted, and then page 4 is printed on the lead half of the reverse face beside the page 1 image.

The result can then be folded to form a signature with properly ordered pages as shown in FIG. 10.

As can be seen, the masters can be prestacked at the master supply station and will be properly fed to the correct print head at the proper time. In this signature printing situation the order and head direction for the masters will be computed in accordance with the page printing plan decided upon. For example, if it should be decided to flip the stack side-over-side of turning it end-for-end, then the page 4 master would be placed ahead of the page 2 master.

Likewise, the page number arrangement (and the corresponding master arrangement) will depend upon the use and arrangement of the signatures. If the signatures are to be bound side by side, then all would be similarly printed to show pages in sequence as 1-2-3-4, 5-6-7-8, 9-10-11-12, etc. However, if the signatures are to be nested (say two signatures in nested relationship) then the outer would have pages 1-2-7-8, and the inner page 3-4-5-6, and this principle would be extended to booklets of larger numbers of nested signatures. In any case, a signature designed to receive impressions of four masters, A-B-C-D (where these letters are used to designate generally the page numbers in ascending sequence regardless of whether these represent contiguous page numbers) would be printed by four masters arranged according to any one of the following sequences:

Where the copy sheet stack is turned end-for-end:

| | |
|---|---|
| Sequence 1. | master A inverted |
| | master C inverted |
| | master B erect |
| | master D erect |
| Sequence 2. | master B erect |
| | master D erect |
| | master A inverted |
| | master C inverted |
| Sequence 3. | master C inverted |
| | master A inverted |
| | master D erect |
| | master B erect |
| Sequence 4. | master D erect |
| | master B erect |
| | master C inverted |
| | master A inverted |

Where the copy stack is flipped side-over-side:

| | |
|---|---|
| Sequence 1'. | master A inverted |
| | master C inverted |
| | master D erect |
| | master B erect |
| Sequence 2'. | master B erect |
| | master D erect |
| | master C inverted |
| | master A inverted |
| Sequence 3'. | master C inverted |
| | master A inverted |
| | master B erect |
| | master D erect |
| Sequence 4'. | master D erect |
| | master B erect |
| | master A inverted |
| | master C inverted |

In the foregoing table the term "erect" is used to identify an orientation of the master in which the master image appears erect to the operator standing at a predetermined location. The term "inverted" identifies a position in which the master has been rotated in its own plane from the orientation in which its image appears erect to the operator (standing at said predetermined location) to an orientation in which its image appears inverted. For convenience, the predetermined location is selected as the one in which the operator is standing at the operator's station facing the near side of print head I in FIG. 1, which is the way the masters are seen in FIGS. 8 and 9. It will, of course, be recognized that if the operator should stand on the opposite side of the machine then the sequences would still be the same except that the orientations would appear to be transposed. For example, the first sequence in the above table would then seem to be:

| | |
|---|---|
| 1) | master A erect |
| | master C erect |
| | master B inverted |
| | master D inverted |

This, however, is exactly the same sequence of masters as below, and it will be readily understood that the designations used in the table above may be understood as identifying the factual sequences in question regardless of the viewing point selected.

Any one of the foregoing arrangements, of course, causes the masters to be so oriented that all pages will appear erect in the fully printed signature, and in the proper order.

The masters are, of course, oriented in each case so that all pages will appear erect in the fully printed signature. This means that the first or lowest numbered page will have its left margin near the center line or fold of the signature, the next higher numbered page its right margin at the fold, the third highest numbered page will be oriented like the first, and the fourth like the second, and the masters must be stacked accordingly. The foregoing chart shows this arrangement in a simple symbolic form which will be readily understood by inspection, the four masters for each signature being stacked as shown in the chart with the symbols from left to right indicating the feed order from the stack (normally top to bottom) or the order in the stream if the masters are produced by a master maker.

In the chart, the master printing image for each page of the four-page signature is manifestly represented by a letter of the alphabet, with the alphabetic order corresponding to the page number progression of the completed signature, whether consecutive or interrupted. Since the stack of copy sheets is maniputated between printing runs, the direction of page heading will change, and the printing impression will have to be inverted in order to match the orientation of the previously printed pages, which requires inverting certain of the masters in the master supply. This inversion is, of course, represented by showing the appropriate letters in the above chart in inverted position. For convenience, the erect and inverted positions are so shown as to relate to the way both the master image and the corresponding printed impression would appear to an operator standing at the operator's station, i.e., facing the near side of print head I in FIG. 1, which is the way they are seen in FIGS. 8 and 9.

The arrangement ∀-Ɔ-B-D of the first example is thus directly analogous to the page number I-Ɛ-2-4 indicated on the four masters as shown in FIGS. 8 and 9 (at the right-hand side thereof). The general symbols would of course represent equally well various other appropriate numerical page sequences suitable for four-page signatures, a few examples of which are shown, together with the corresponding master arrangements of both the ∀-Ɔ-B-D type and the ∀-Ɔ-D-B type.

| Exemplary Page sequences corresponding to the general symbols A-B-C-D | Corresponding Master Sequences and Orientations | |
|---|---|---|
| | On basis of first Chart Example ∀-Ɔ-B-D | On basis of Second Chart Example ∀-Ɔ-D-B |
| 3-4-5-6 | 3-4-5-6 | 3-6-5-4 |
| 1-2-7-8 | 1-2-7-8 | 1-8-7-2 |

The table above can obviously be extended to cover any normal desired four-page sequence, and a similar table can, of course, be prepared for each of the six generalized arrangements.

It will be understood, of course, that the letter symbols used in the above chart are used in the same manner and have identical meanings wherever used in this application, and the subjoined claims.

From the foregoing description it can be seen that the present invention provides a novel type of duplicating equipment in which printing on both faces of the copy sheet can be readily and easily effected. This facility of operation is enjoyed even when the printing operation involves the production of a series of sheets which must bear a certain relation to each other in the resulting book or pamphlet. It is also enjoyed when the total number of books or pamphlets is small, so that very few copies are produced during each printing run, so that printing runs with new masters must be established at extremely short intervals. The equipment and processes described make possible an operation involving minimum operator intervention during the printing procedure and thereby provide aspects of combined speed and accuracy in a range altogether unattainable using equipment available heretofore.

Further, novel procedures in the arrangement, stacking and processing of masters, so as to avoid complications and possible errors, have been devised in accordance with the invention described herein.

In addition, equipment has been devised which is flexible in nature and which is capable of use in various alternative ways. In particular, the duplicator is capable of being associated with a pack feed for pre-imaged masters, or for receiving its input as a stream of masters being substantially currently prepared by an on-line master maker, with only nominal changes. The duplicator is also capable of use in more than one mode so that, of a pair of masters to be mounted upon the master cylinders of the two print heads, the first master may be automatically guided either to the first head or to the second head, with the second master of the pair then being guided to the remaining head.

The duplicator of the invention described is capable, also of conversion to single head printing or dual printing in a straightforward manner, as well as conversion to a mode in which a permanent image is printed by one head while the other head prints with masters which are automatically changed at intervals.

Most fundamentally, however, the present invention is concerned with the arrangement of a duplicator which provides two printing heads for printing twice on each copy sheet processed, and which is arranged with a single master supply, together with transport equipment by which masters are fed from such single supply to both print heads in proper order in a manner which is essentially completely automated once the masters have been suitably arranged at the single supply source. This is a highly important simplifiction for the operator because it makes possible the confinement of master arrangement questions, if any, to a single stack or source where the relative positioning is firmly under control, rather than necessitating two stacks or sources where the position of masters in one source relative to those in the other is difficult to ascertain and establish, and extremely difficult to check in case of doubt or necessity for revision.

What is claimed is:

1. Duplicating apparatus comprising:

first and second print heads;

means to feed copy sheets to the print heads, each copy sheet first to the first print head and then to the second;

a single master supply comprising a plurality of masters and being the sole source of masters for both of said print heads;

means for taking one master from the supply and conveying it to one of said print heads;

means for taking an immediately following master from the supply and conveying it to the other print head;

means for operating the print heads to print on the copy sheet first from said one master and then from the other;

means for interrupting the printing operation after a desired number of copies have been produced; and means for sequentially and repetitively removing the masters from the print heads, and activating said taking and conveying means to provide a replacement master on each head after each printing operation;

whereby the arrangement of images on the printed copy sheets can be precontrolled for a series of printing runs by the arrangement of the masters relative to each other in a single master supply.

2. Duplicating apparatus as set forth in claim 1 in which the copy sheet feeding means includes a sheet turnover mechanism in the copy sheet path between the first and second print heads for inverting the copy sheet between impressions, and wherein there is provided a collator for receiving the sheets from the second print head, whereby masters from a single supply source arranged in order of pages can produce copy sheet stacks in the collator with sheets printed on both sides, wherein the sheets are in correct page order.

3. Duplicating apparatus as set forth in claim 1 in which the master taking and conveying means, in combination, comprise means for feeding the masters away from the master supply to a switch point, first conveying means leading from the switch point to the first print head, second conveying means leading from the switch point to the second print head, and a gate at the switch point for receiving a master from the master feeding means and directing it selectively to one conveying means or the other.

4. Duplicating apparatus as set forth in claim 3 in which there is provided means for controlling the gate, including means to sense the sequential approach of two masters of a pair, and to signal arrival of the masters at predetermined locations, and means responsive to said signals to set the gate in position for directing the first master of a pair to one conveying means and the second master of the same pair to the other conveying means.

5. Duplicating apparatus as set forth in claim 4 in which there is also provided manual control means for selectively setting the gate controlling means to a condition such that the gate will direct the first master of a pair of masters to the conveying means leading to the first head and the second master of the pair to the conveying means leading to the second head, or to a condition such that the gate will direct the first master of a pair of masters to the conveying means leading to the second head, and the second master of the pair to the conveying means leading to the first head.

6. Duplicating apparatus as set forth in claim 4 in which the means for taking masters from the single supply and conveying them to the print heads comprise electric circuit means for activating the taking means to take a pair of masters into the system from the single supply, and then preventing the taking of further masters until completion of a printing run with the thus taken masters has occurred.

7. Duplicating apparatus as set forth in claim 6 in which there is also provided means for selectively deactivating the printing action of one of the print heads, and means to selectively activate the master taking and conveying means for the other of said print heads only to feed masters individually to the other of said print heads only.

8. Duplicating apparatus as set forth in claim 8, in which the print heads are each provided with print control means and master insertion and ejection means, the said means for at least one print head being independently activatible and deactivatible, and which includes means for selectively deactivating the master insertion and ejection action of one of the print heads without disabling the balance of its printing action, means for selectively activating the master taking and conveying means for the other of said print heads only to feed masters individually to the other of said print heads solely; and means for converting the circuit means for activating the taking of masters in pairs to a condition activating the taking of masters one by one for each printing cycle, whereby the apparatus may be converted from printing with automatically changeable masters on both heads to printing with a fixed master on one head and automatically changeable masters on the other, and vice versa.

9. Duplicating apparatus as set forth in claim 1 in which the print heads are arranged in tandem and in which the master taking and conveying means, in combination, comprise means for feeding the masters away from the master supply to a switch point, first conveying means leading from the switch point to the first print head, second conveying means overlying the first print head and leading from the switch point in the second print head, and a gate at the switch point for receiving a master from the master feeding means and directing it selectively to one conveying means or the other.

10. Duplicating apparatus as set forth in claim 9 in which at least a portion of the second conveying means is movably mounted and provided with ready release means to permit moving the same to raised position allowing access to the first print head.

11. Duplicating apparatus as set forth in claim 1 in which the means for taking masters from the single supply and conveying them to the print heads comprise electric circuit means for activating the taking means to take a pair of masters from the single supply, and then preventing the taking of further masters until completion of a printing run with the thus taken masters has occurred.

12. Duplicating apparatus as set forth in claim 11, in which there is also provided means for selectively deactivating the printing action of one of the print heads, and means to selectively activate the master taking and conveying means for the other of said print heads only to feed masters individually to the other of said print heads solely; and means for converting the circuit means for activating the taking of masters in pairs to a condition activating the taking of masters one by one for each printing cycle, whereby the apparatus may be converted from dual printing with automatically changeable masters to single impression printing with a single automatically changeable master, and vice versa.

13. Duplicating apparatus as set forth in claim 1 in which there is also provided means for selectively deactivating the printing action of one of the print heads, and means to selectively activate the master taking and conveying means for the other of said print heads only to feed masters individually to said other of said print heads only, to thereby provide for selectively converting the apparatus to a condition for single impression duplicating as desired.

14. Duplicating apparatus as set forth in claim 1 in which single master supply is provided by means of a pack feeder in which preimaged masters are stacked.

15. Duplicating apparatus as set forth in claim 1 in which the single master supply comprises a stream of masters and an electrostatic master maker for producing the masters from originals presented sequentially to the master maker, whereby a sequence of originals introduced into the master maker input results in a master supply whose sequence corresponds to the sequence of the originals.

16. The method of printing copy sheets with two impressions per sheet, on a dual head duplicator, which conprises:

a. preparing duplicating masters one for each different impression to be made;
b. arranging the masters in a single sequence of pairs with the masters applicable to any one sheet making up a pair;
c. mechanically withdrawing a pair of masters, one at a time, in sequence order, from the master sequence;
d. mechanically feeding the first withdrawn master of the pair to one of the printing heads of the dual head duplicator and installing it thereon;
e. mechanically feeding the second withdrawn master of the pair to the other printing head of the dual head duplicator and installing it thereon;
f. operating the dual head duplicator to print copy sheets bearing images of both masters of the pair;
g. mechanically counting the operations of the duplicator and mechanically terminating the printing of copy sheets when a preset number has been produced;

h. mechanically removing the masters from the printing heads;

i. repeating the cycle of steps (*c*) to (*h*) until all masters in the sequence have been used.

17. The method of printing copy sheets on both sides, on a dual head duplicator having first and second printing heads, and collecting them to form a predetermined number of books with pages arranged in a predetermined sequence which comprises:

a. preparing duplicating masters, one for each page;

b. arranging the masters in a single sequence corresponding to the desired page sequence c. mechanically withdrawing a pair of masters, one at a time, in sequence order, from the master sequence;

d. mechanically feeding the first withdrawn master of the pair to the first printing head of the dual head duplicator and installing it thereon;

e. mechanically feeding the second withdrawn master of the pair to the second printing head of the dual head duplicator and installing it thereon;

f. operating the dual head duplicator to print copy sheets bearing the image of the first master of the pair on one side of a copy sheet and then inverting the sheet so that the image of the second master of the pair appears on the other side;

g. feeding the sheets printed by each master pair in turn to a collator with the side first printed face down, and distributing them into collator pockets, one sheet to each pocket;

h. mechanically counting the operations of the duplicator and mechanically terminating the printing of copy sheets when said predetermined number have been produced;

i. mechanically removing the masters from the printing heads; and j. repeating the cycle of stes (*c*) to (*i*) until all masters in the sequence have been used.

18. The method of printing set forth in claim 17 in which the books to be produced each include a blank page, and which includes inserting into the sequence of masters a blank master at a location corresponding to that of the blank page.

19. The method of printing on a dual head duplicator, copy sheets each of a length to provide two-page areas on each face to produce a four-page signature having a desired page sequence represented by A-B-C-D, which comprises:

a. preparing four duplicating masters of page area size, one for each page of the signature to be printed, which masters may be considered as designated A-B-C and D in correspondence with the signature pages whose images they bear, and each of which, when viewed in a planar face-up condition, may occupy either an erect position in which its image appears erect to the operator at a predetermined location, or an inverted position in which the master is rotated within its plane from said erect position to one in which its image appears inverted to the operator at said location;

b. orienting and ordering the four masters to form a sequence which is one selected from the group of sequences consisting of:

| | |
|---|---|
| Sequence 1 | master A inverted |
| | master C inverted |
| | master B erect |
| | master D erect |
| Sequence 2 | master B erect |
| | master D erect |
| | master A inverted |
| | master C inverted |
| Sequence 3 | master C inverted |
| | master A inverted |
| | master D erect |
| | master B erect |
| Sequence 4 | master D erect |
| | master B erect |
| | master C inverted |
| | master A inverted |

c. mechanically withdrawing a pair of masters, one at a time, in sequence order from the master sequence;

d. mechanically feeding the first withdrawn master to one of the print heads of the dual head duplicator and installing it thereon;

e. mechanically feeding the second withdrawn master to the other print head of the dual head duplicator and installing it thereon;

f. operating the dual head duplicator to feed the copy sheets from a copy sheet supply site lengthwise to the print heads in such manner that each sheet is first fed to the first print head which prints the image of the first master of the pair on the leading page area half of one face of the sheet, and then mechanically inverting the sheet end-over-end so than the image of the second master of the pair is printed on the leading page area half of the other face of the sheet by the second print head.

20. The method of printing on a dual head duplicator, copy sheets each of a length to provide two-page areas on each face to provide a four-page signature having a desired page sequence represented by A-B-C-D, which comprises;

a. preparing four duplicating masters of page area size, one for each page of the signature to be printed, which masters may be considered as designated A-B-C and D in correspondence with the signature pages whose images they bear, and each of which, when viewed in a planar face-up condition, may occupy either an erect position in which its image appears erect to the operator at a predetermined location, or an inverted position in which the master is rotated within its plane from said erect position to one in which its image appears inverted to the operator at said locations;

b. orienting and ordering the four masters to form a sequence which is one selected from the group of sequences consisting of:

| | |
|---|---|
| Sequence 1′ | master A inverted |
| | master C inverted |
| | master D erect |
| | master B erect |
| Sequence 2′ | master B erect |
| | master D erect |
| | master C inverted |
| | master A inverted |
| Sequence 3′ | master C inverted |
| | master A inverted |
| | master B erect |
| | master D erect |
| Sequence 4′ | master D erect |
| | master B erect |
| | master A inverted |
| | master C inverted |

c. mechanically withdrawing a pair of masters, one at a time, in sequence order, from the master sequence;

d. mechanically feeding the first withdrawn master to one of the print heads of the dual head duplicator and installing it thereon;

e. mechanically feeding the second withdrawn master to the other print head of the dual head duplicator and installing it thereon;

f. operating the dual head duplicator to feed the copy sheets from a copy sheet supply site lengthwise to the print heads in such manner that each sheet is first fed to the first print head which prints the image of the first master of the pair on the leading page area half of one face of the sheet, and then mechanically inverting the sheet end-over-end so that the image of the second master of the pair is printed on the leading page area half of the other face of the sheet by the second print head;

g. inverting the stack of printed sheets side-over-side;

h. thereafter returning the stack of sheets to the copy sheet supply site of the duplicator; and i. repeating steps (*c*), (*d*), (3) and (*f*) with the partially printed copy sheets as the copy sheet supply.

* * * * *

UNITED STATES PATENT AND TRADEMARK OFFICE

CERTIFICATE OF CORRECTION

PATENT NO. : 3,987,722
DATED : October 26, 1976
INVENTOR(S) : Eber Lyle Goodwin

It is certified that error appears in the above-identified patent and that said Letters Patent are hereby corrected as shown below:

| | |
|---|---|
| Col. 1, line 54 | "take" should read --takes--. |
| Col. 4, line 24 | "good" should be deleted and --second-- should be substituted therefor. |
| Col. 6, line 11 | "SI" should read --S1--. |
| Col. 12 | Instead of its present position, the paragraph occupying lines 52 to 56 should follow the paragraph ending on line 36 of column 12. |
| Col. 13, line 16 | After "side-over-side" --instead-- should be inserted. |
| Col. 17, line 29 (Claim 7, line 1) | "claim 6" should read --claim 4--. |
| Col. 17, line 36, (Claim 8, line 1) | "claim 8" should read --claim 11--. |
| Col. 17, line 64 (Claim 9, line 8) | "in" should be deleted and --at-- should be substituted therefor. |

Signed and Sealed this

Eleventh Day of January 1977

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,987,722 Dated October 26, 1976

Inventor(s) Eber Lyle Goodwin

It is certified that error appears in the above-identified patent and that said Letters Patent are hereby corrected as shown below:

Column 14, line 27, "below" should read -- before --.

The five paragraphs starting at column 14, line 35, and extending to column 15, line 29, should be deleted in their entirety.

Column 17, line 64 "in" should read -- to --.

Column 22, line 11, "3" should read -- e --.

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*